United States Patent [19]

Hiramatsu et al.

[11] Patent Number: 4,803,937

[45] Date of Patent: Feb. 14, 1989

[54] METHOD AND APPARATUS FOR ATTACHING A ZIPPER TO A GARMENT

[75] Inventors: Tooru Hiramatsu; Kazuya Tami; Shigeru Tobita, all of Tokyo, Japan

[73] Assignee: Juki Corporation, Tokyo, Japan

[21] Appl. No.: 157,388

[22] Filed: Feb. 18, 1988

[30] Foreign Application Priority Data

Feb. 19, 1987 [JP] Japan ..... 62-36392

[51] Int. Cl.[4] ..... D05B 97/00; D05B 21/00

[52] U.S. Cl. ..... 112/265.2; 112/121.12; 112/104

[58] Field of Search ..... 112/265.2, 265.1, 262.3, 112/121.15, 121.11, 121.12, 104

[56] References Cited

U.S. PATENT DOCUMENTS

| | | | |
|---|---|---|---|
| 3,605,665 | 9/1971 | Donald | 112/265.2 |
| 3,710,245 | 1/1973 | Yoshikawa | 112/265.2 |
| 3,718,105 | 2/1973 | Glindmeyer | 112/265.2 |
| 4,265,190 | 5/1981 | Moertel | 112/265.2 |
| 4,359,008 | 11/1982 | Newman | 112/104 |
| 4,534,067 | 8/1985 | Richardson | 112/265.2 |
| 4,660,821 | 4/1987 | Boser et al. | 112/121.11 X |

*Primary Examiner*—H. Hampton Hunter

*Attorney, Agent, or Firm*—Morgan & Finnegan

[57] ABSTRACT

A method and apparatus for attaching a zipper when a zipper is attached to a garment which provides a flap to cover the zipper attached thereto, conducted such that a "perfect stitch" line appears on the garment surface and a "hitch stitch" line is covered by the garment flap. Thereby, the quality of stitching work is not degraded.

2 Claims, 9 Drawing Sheets

METHOD AND APPARATUS FOR ATTACHING A ZIPPER TO A GARMENT

BACKGROUND OF THE INVENTION

This invention relates to a method of attaching a zipper to a garment and, more particularly, the invention is applicable where the garment provides a flap to cover a zipper attached thereto.

Generally, when a zipper is attached to a skirt or trouser, a flap is provided to cover the zipper and is formed by turning and overlapping some portion of garment material. Referring to FIG. 5 and FIG. 6, one conventional method of attaching a zipper to a garment will be explained. Referring to FIG. 5A and FIG. 5B, a zipper F has a slider S and two zipper tapes $FT_1$, $FT_2$. The two zipper tapes FT: and $FT_2$, are connected by a bottom portion $FT_{12}$. Referring to FIG. 5B, the flap Wf is formed by turning and overlapping a front cloth $W_1$ and the flap Wf is placed on the zipper tape $FT_1$. A front cloth $W_2$, is turned and overlapped and is placed on the zipper tape $FT_2$.

Referring to FIG. 6A, the above-mentioned workpiece is placed on a sewing machine table Mt. Referring to FIG. 6B, the flap Wf and the zipper tape $FT_1$ are stitched. Referring to FIG. 6C, when the stitch line reaches to the bottom $FT_{12}$, the sewing machine is stopped in the needle-down position and the workpiece is rotated by 90 degrees in the direction of arrow "a".

Referring to FIG. 6D, the sewing machine is started again such that the bottom $FT_{12}$, is sewed to the flap Wf and the sewing machine is stopped in the needle-down position. Then the workpiece is rotated by 90 degrees in the direction of arrow "b" in FIG. 6D. Referring to FIG. 6E, the sewing machine is started again and the workpiece is fed in the direction of the arrow in FIG. 6E until the stitch line reaches the tip-end portion of the front cloth $W_2$. Referring to FIG. 6F, when the stitch line reaches the end of the front cloth $W_2$, the sewing machine is stopped and the thread is cut. Thus, the zipper is attached to the garment.

As described above, the operator has to rotate the workpiece at each stitching line corner, so the stitch line $S_1$ $S_2$ $S_3$ is performed by constantly feeding the workpiece forward. Thereby, each stitch line is a so-called "perfect stitch".

Referring to FIG. 7, it is apparent that the stitch pitch forms "perfect stitch" Sp when the workpiece is fed forwardly, and forms "hitch stitch" Sh when the workpiece is fed reversely. The merits of this conventional method are that 21 each stitch line is a "perfect stitch" but the demerits are that the operator has to rotate the workpiece twice. Further, the operator has to stop the needle in the needle-down position when the machine is stopped and such manual work lowers productivity.

Recently, an automatic zipper attaching machine which eliminates the two rotations of the workpiece has been developed, such that the workpiece is set in a frame and is moved in the X-Y direction accordingly. Since the rotation work is eliminated, if the left zipper tape $FT_1$ is sewed in forward feed, the right zipper tape $FT_2$ will be sewed in reverse feed. So, in this case, the right side stitch line will be hitch stitched and such a hitch stitched line degrades the quality of stitching work and the commercial value is lowered.

Referring to FIG. 7, when the workpiece W is fed forward, the stitch line will be a perfect stitch Sp, and when the workpiece is fed reverse, the stitch line will be a hitch line Sh. It is generally apparent that hitch stitch appearing on the garment surface degrades its commercial value, so how to automatically attach a zipper without hitch stitch lines and how to conceal hitch stitch lines are problems requiring solution.

SUMMARY OF THE INVENTION

With the foregoing in mind, it is an object of this invention to provide an improved method and apparatus for attaching a zipper to a garment.

Referring to FIG. 4C, when a flap Wf is provided to cover a zipper F, a stitch line $S_1$ appears at the garment surface, while a stitch line $S_3$ is covered by the flap and is concealed. So, the stitch line $S_1$ shall be stitched by feeding forwardly and the stitch line $S_3$ shall be stitched by feeding reversely, such that no hitch stitch lines appear on the garment surface.

According to the present invention, a zipper is sewed to a garment without degrading the garment's commercial value and rotation of the workpiece twice is eliminated. An existing sewing machine can be easily modified to conduct the present invention and resultantly the productivity will be highly Promoted.

BRIEF DESCRIPTION OF THE DRAWINGS

The accompanying drawings, referred to herein and constituting a part hereof, illustrate a preferred embodiment of the invention and, together with the description, serve to explain the principles of the invention, wherein.

DETAILED DESCRIPTION OF THE DRAWINGS

Referring to drawings from FIG. 1 to FIG. 4, one referred embodiment of the Present invention will be explained.

Figure 1:
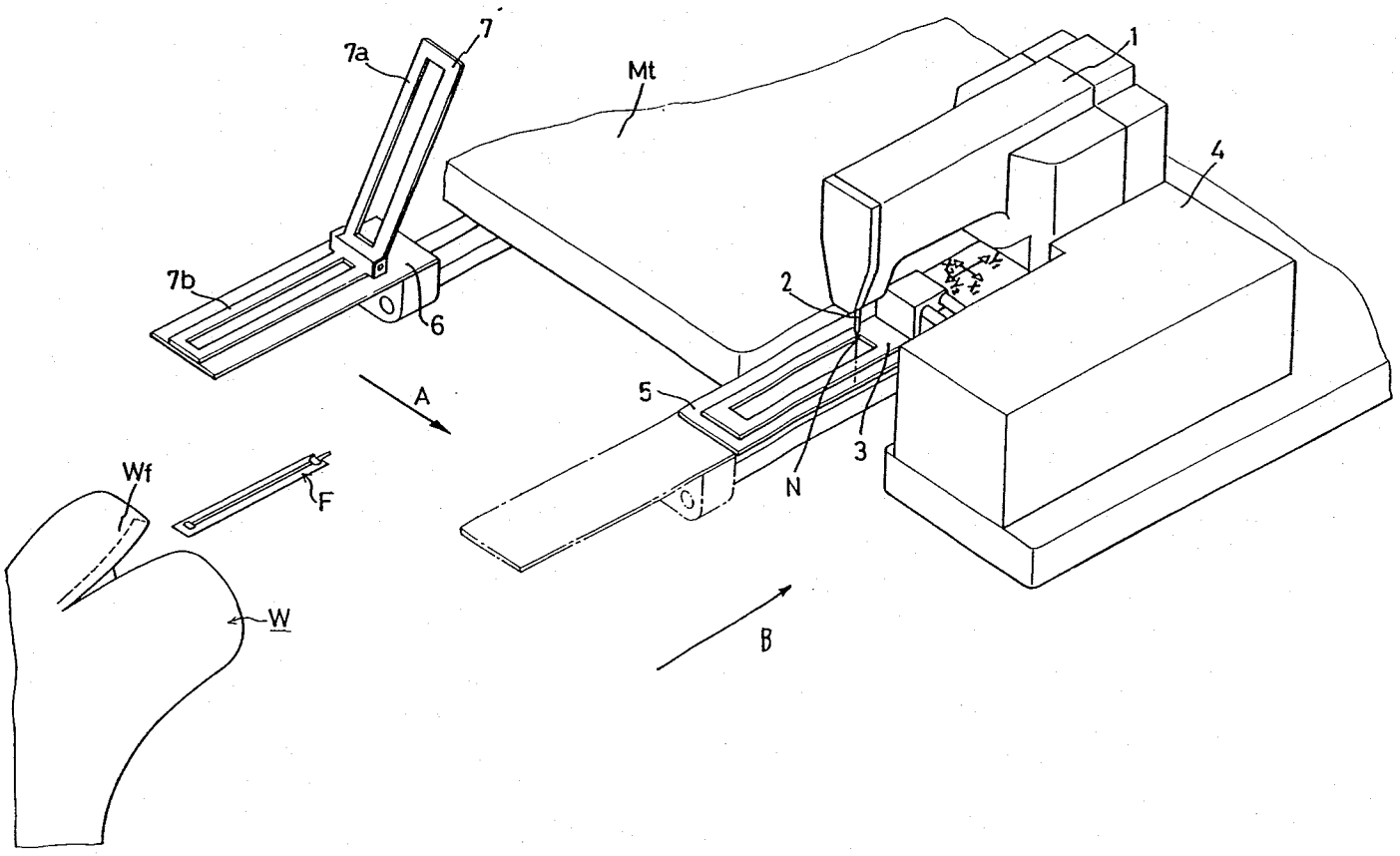
FIG. 1 is a perspective view of a sewing machine wherein one embodiment of the present invention is applied.
Figure 3:
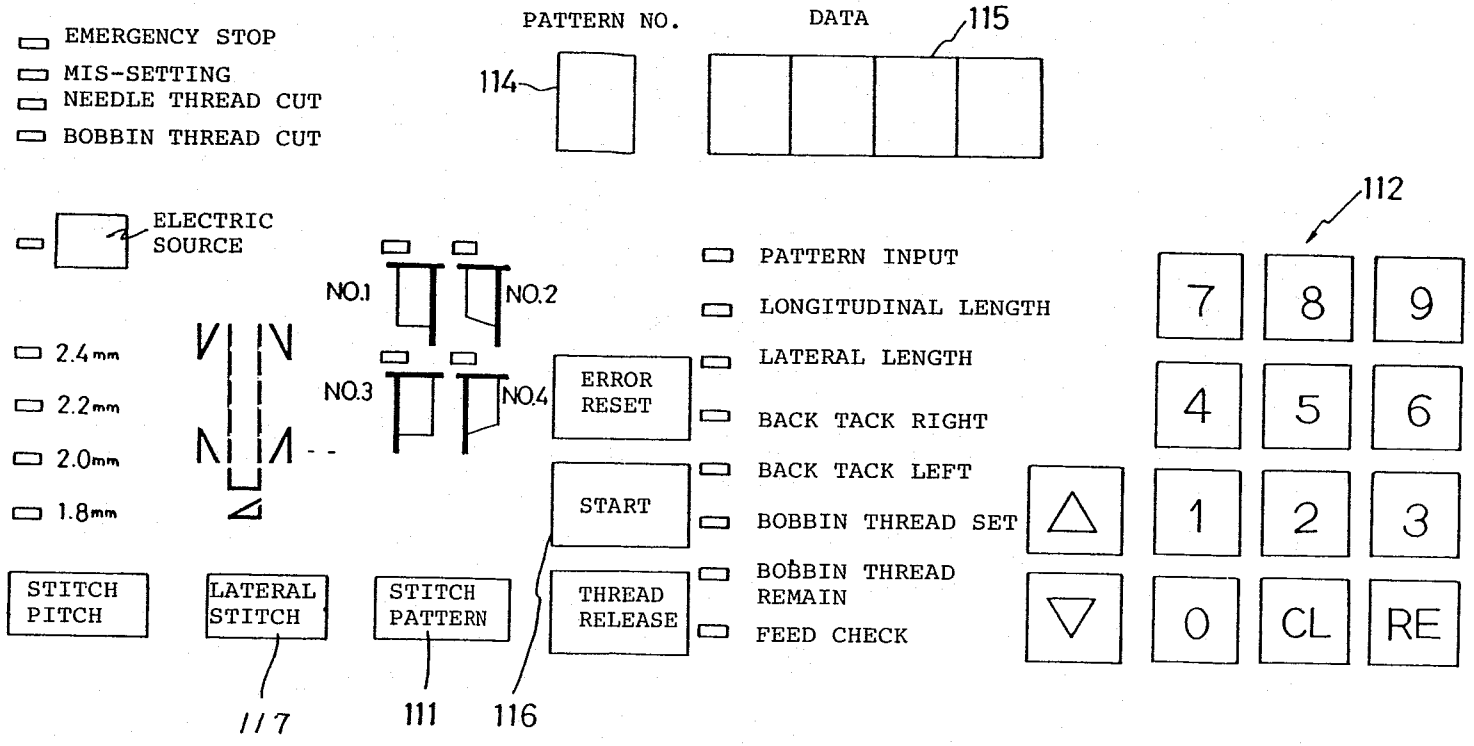
FIG. 3 is a plan view of an input device shown in FIG. 2.

Referring to FIG. 1 and FIG. 3 an automatic zipper attaching machine applied with the present invention will be explained. Numeral 1 denotes a sewing machine, numeral 2 denotes a needle bar, numeral 3 denotes an X-Y table, numeral 4 denotes a X-Y driver, numeral 5 denotes a throat plate. The X-Y table 3 is arranged to move in the direction of X-Y along the surface of the throat plate 5 by the X-Y driver 4. Numeral 6 denotes a set-table which moves in the direction of arrow "A". Numeral 7 denotes a casset which comprises two openable frames *7a*, *7b*. These openable frames *7a*, *7b* clamp the workpiece. The workpiece is moved in direction of arrow "B" such that the workpiece is set for stitching.

Figure 2:
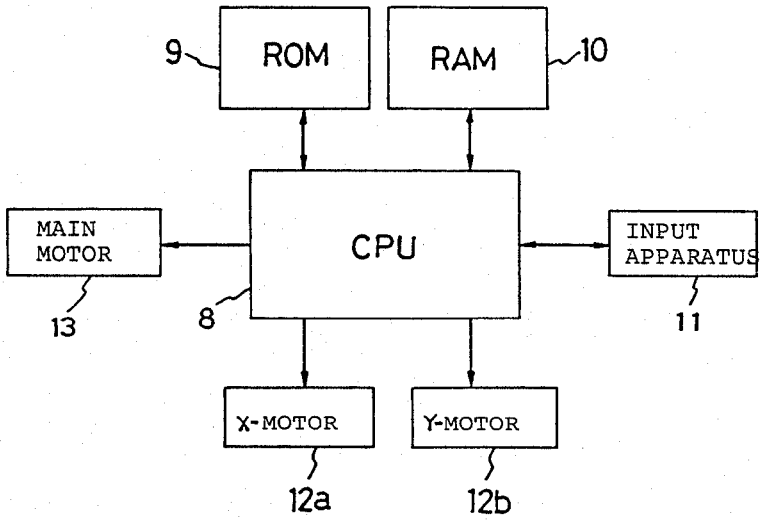
FIG. 2 is a block diagram related to a control circuit of the sewing machine shown in FIG. 1.

FIG. 2 is a block diagram which illustrates how the X-Y driver 4 is controlled. Referring to FIG. 2, numeral 8 denotes a CPU, numeral 9 denotes a ROM which stores control programs, numeral 10 denotes a RAM which stores input data from input device 11 shown in FIG. 3. Numeral 12*a* denotes an X-motor, numeral 12*b* denotes a Y-motor, and these are set in the X-Y driver 4. Numeral 13 denotes a main motor installed in the sewing machine 1 (FIG. 1). Both X-motor 12*a* and Y-motor 12*b* are controlled by the CPU 8.

Figure 4A:
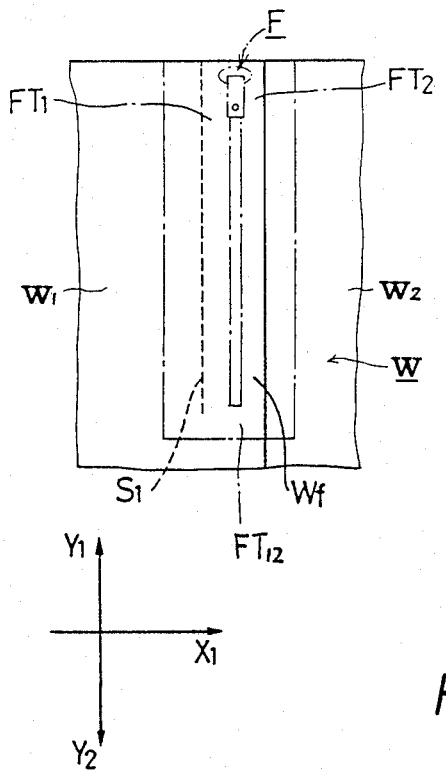
FIG. 4A, FIG. 4B, and FIG. 4C are explanatory drawings according to the present invention illustrating how a zipper is stitched step by step to a garment.
Figure 4B:
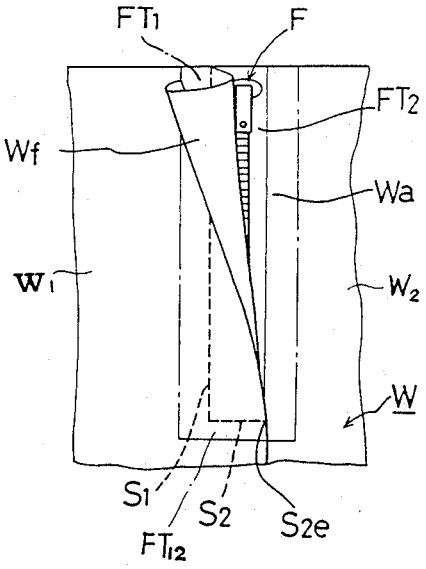
Figure 4C:
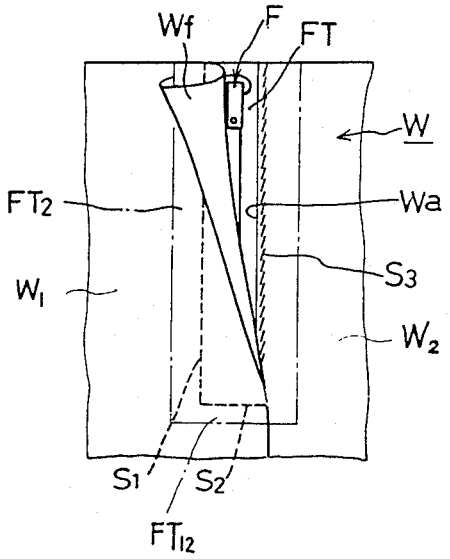
Figure 5A:
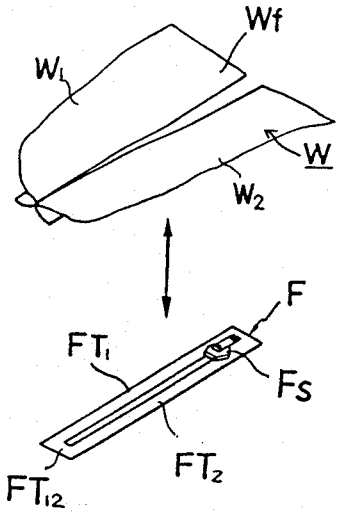
FIG. 5A is an explanatory perspective view drawing illustrating how a zipper and a garment are overlapped.
Figure 5B:
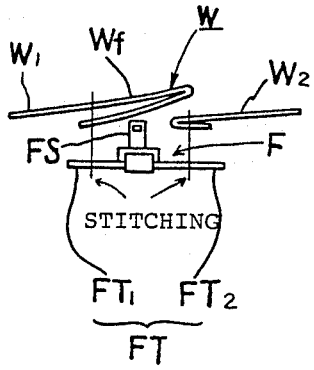
FIG. 5B is an explanatory section view drawing illustrating the positional relation between a zipper, a garment and a flap before the stitching starts; and From FIG. 6A to FIG. 6F are explanatory drawings illustrating a conventional method of sewing zipper to a garment step by step.
Figure 6A:
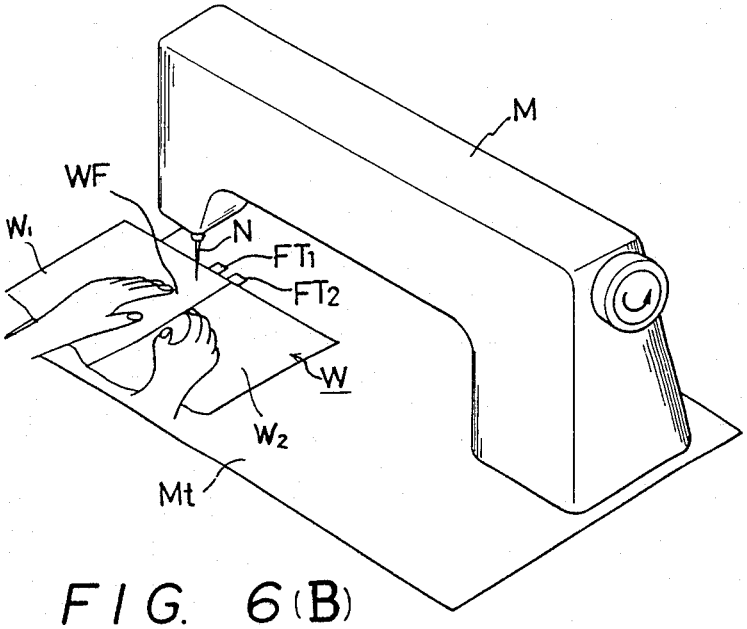
Figure 6B:
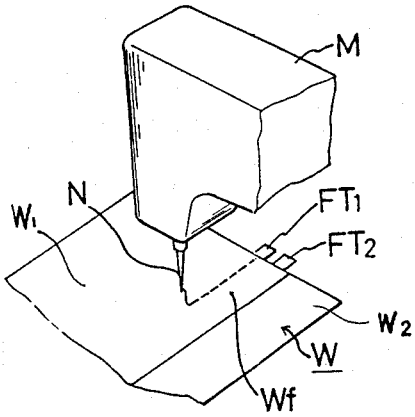
Figure 6C:
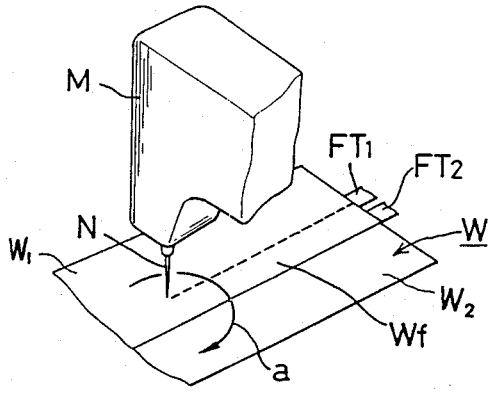
Figure 6D:
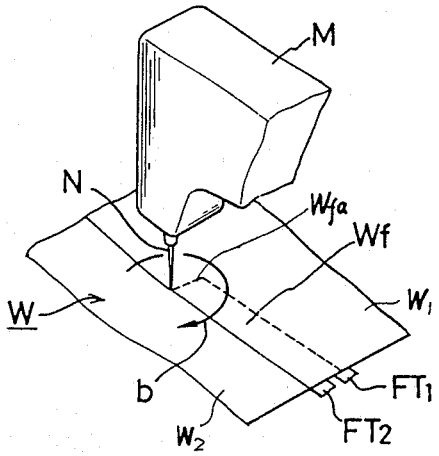
Figure 6E:
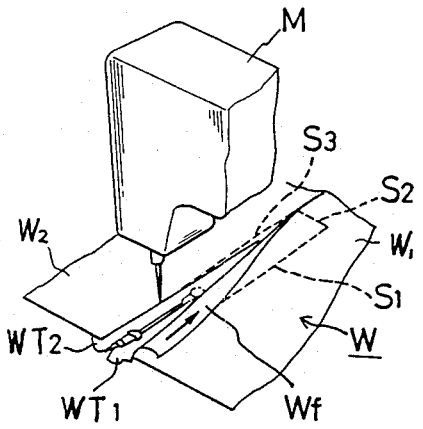
Figure 6F:
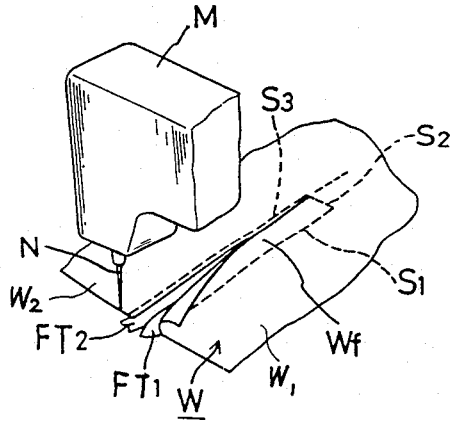
Figure 7:
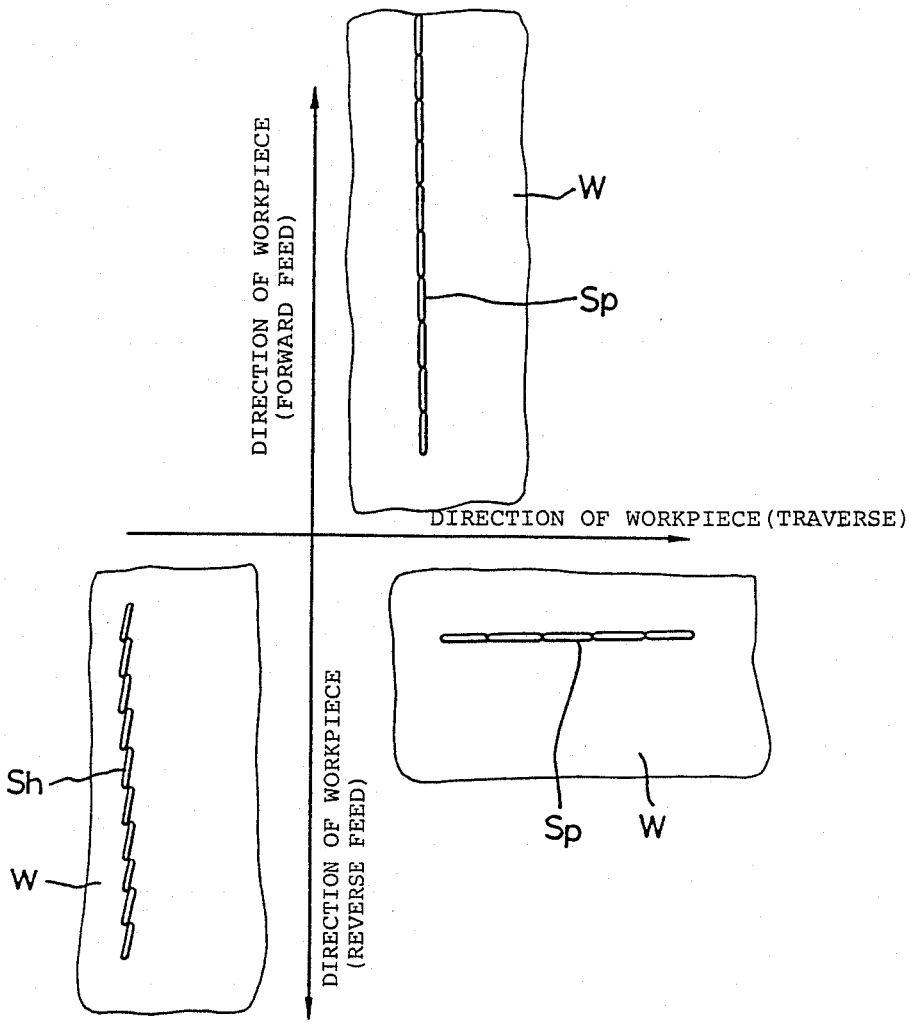

Referring to FIG. 4, a method of attaching a zipper to a garment according to the present invention using the aforementioned sewing machine will be explained hereinafter. An operator sets a front cloth W and a zipper F on the frame 7*b* as shown in FIG. 5B, and then the upper frame 7*a* is closed such that the front cloth W and the zipper F are clamped by the frames 7*a* and 7*b*. Then the set-table 6 is moved in direction of "A" until it reaches to the throat plate 5 as shown by the chain line in FIG. 1. Then, the casset 7 is slid on the X-Y table 3 and is fixed on the X-Y table 3. Thus the front cloth W and the zipper F are fixed on the X-Y table 3. The operator selects one stitch pattern among four stitch patterns by pressing a pattern selection switch 111. Four patterns are provided, as shown NO. 1–NO. 4.

The fat line indicates rim line of the flap, so patterns NO. 1 and NO. 2 correspond to the flap configuration shown in FIG. 4 and the flap is turned over to left side to be opened. In the case of NO. 2, a stitch line at bottom of the zipper is aslant for decorative purposes. In the case of stitch patterns NO. 3 and NO. 4, the flap is turned over to the right side to be opened.

After selecting one of the stitch patterns from among the four stitch patterns, the operator sets the longitudinal and lateral dimension of the stitch line and a stitch pitch by pushing ten-key pad 112 and a selection switch 113. The lateral line stitch pattern is selected by pressing a lateral stitch selection switch 117.

There are three lateral stitch patterns namely "without lateral stitch", "with lateral stitch", and "lateral stitch with bar tack" as shown in FIG. 3. Back tacking may be selected at the start or end of a stitch, so there are several patterns and these patterns are each given pattern numbers. The selected pattern number is displayed at a pattern number indicator 114. The stitch line dimensions are displayed at a data indicator 115. The above selected and set data are stored in the RAM 10. Then the operator pushes a start button 116. The CPU 8 commands stitching in response to data stored in the RAM and following the program stored in the ROM 9.

The stitch pattern number will be selected such that the stitching for the flap Wf shall be stitched by forward feeding and the perfect stitch will appear on the garment. If the stitch pattern NO. 1 was previously selected, the CPU 8, storing the input data, drives the X-motor 12*a* and moves the X-Y table 3 such that the stitch-start point is positioned just under the needle. Then, the CPU 8 drives the Y-motor 12*b* such that the X-Y table 3 is moved in the direction of arrow "Y" in FIG. 4A and simultaneously drives the main motor 13 such that the zipper tape $FT_1$ is sewed to the flap portion Wf. When the stitch line reaches to the bottom $FT_{12}$, the CPU 8 stops the Y-motor 12*b* and drives the X-motor 12*a* and stitches the preset dimension such that the bottom portion of the flap Wf is stitched Thus, the first step is finished and stitch line $S_1$ $S_2$ is a perfect stitch.

After finishing the first step, the flap Wf is turned over manually or mechanically. Then the start switch 116 is pressed again, and the main motor 13 and the X-Y driver 4 operate. The CPU 8 drives Y-motor 12*b* such that the X-Y table is reverse fed. By this reverse feed, the zipper tape $FT_2$ is sewed to the flap-covered portion Wa, starting from $S_{2e}$ till the end of the front cloth $W_2$. When the stitching reaches the end, the main motor 13 and the Y-motor 12*b* stop, and thus the second step is finished. In this second step, the reverse feeding forms the hitch stitch Sh, but this hitch stitch is covered by the flap Wf and does not appear on the garment so its commercial value will not be lowered.

The aformentioned embodiment is conducted by an automatic sewing machine which moves the front cloth and the zipper in the X-Y direction, but it is also possible to use a simple sewing machine with manual work. Even in such a case, the rotation of the workpiece will be eliminated so the productivity is higher than normal. In the aforementioned embodiment, the stitch line at the bottom $FT_{12}$ is in direction of X, but an aslant stitch line is also applicable as shown as patterns NO. 2 and NO. 4 in FIG. 3.

As many apparently widely different embodiments of the invention may be made without departing the spirit and scope thereof, it is to be understood that invention is not limited to the specific embodiment thereof except as defined in the appended claims.

What is claimed:

1. A method of attaching a zipper, the zipper having a zipper tape on each side thereof and a zipper bottom connected to the zipper tapes, to a garment, comprising the steps of:

(a) attaching one of the zipper tapes and the zipper bottom to the garment;

(b) forming a flap in the garment;

(c) attaching the other of the zipper tapes to the garment such that said flap covers the zipper surface; and wherein the attachment of said one of the zipper tapes and the zipper bottom to the garment is by a perfect stitch and the other zipper tape is attached to the garment by a hitch stitch.

2. A sewing machine for attaching a zipper, the zipper having a zipper tape at each side thereof and a zipper bottom connected to said zipper tapes, to a garment, comprising:

(a) means for attaching one of the zipper tapes and the zipper bottom to the garment;

(b) means for forming a flap in the garment;

(c) means for attaching the other of the zipper tapes to the garment such that said flap covers the zipper surface; and wherein said means for attaching said one of the zipper tapes and the zipper bottom performs a perfect stitch and said means for attaching the other of the zipper tapes performs a hitch stitch.

* * * * *